United States Patent [19]

Kimura et al.

[11] Patent Number: 4,887,072

[45] Date of Patent: Dec. 12, 1989

[54] ALARM APPARATUS

[75] Inventors: Tetsuo Kimura; Akihiro Kobayashi, both of Tokyo, Japan

[73] Assignee: Nittan Company, Limited, Tokyo, Japan

[21] Appl. No.: 163,708

[22] Filed: Mar. 3, 1988

[30] Foreign Application Priority Data

Mar. 31, 1987 [JP] Japan ..... 62-75963

[51] Int. Cl.[4] ..... G08B 17/06; G08B 25/00; G08B 27/00

[52] U.S. Cl. ..... 340/691; 340/501; 340/529; 340/587

[58] Field of Search ..... 340/691, 693, 501, 529, 340/530, 584, 587, 628, 630

[56] References Cited

U.S. PATENT DOCUMENTS 4,223,303 9/1980 Albinger, Jr. ..... 340/628

FOREIGN PATENT DOCUMENTS 52-29199 3/1977 Japan .
54-5698 1/1979 Japan .
1460281 12/1976 United Kingdom ..... 340/584
1491222 9/1987 United Kingdom ..... 340/693

*Primary Examiner*—Glen R. Swann, III
*Attorney, Agent, or Firm*—Hill, Van Santen, Steadman & Simpson

[57] ABSTRACT

An alarm apparatus includes a plurality of sensors connected in parallel with each other between sensor lines extending from a receiver and sounding devices connected between the sensor lines in correspondence to at least one of the sensors. The receiver includes a unit for changing a voltage supply condition of the sensor lines. A control circuit is provided to each audio device so as to selectively control the audio devices when the voltage supply condition is changed, so that a audio device corresponding to an activated sensor, or all of the audio devices, can be arbitrarily controlled to generate audio alarm signals.

9 Claims, 1 Drawing Sheet

ALARM APPARATUS

BACKGROUND OF THE INVENTION

The present invention relates to an alarm apparatus for detecting an environmental abnormality such as a fire or gas leakage and, more particularly, to an audio signal generator of an alarm apparatus.

For example, Japanese Patent Disclosures (Kokai) Nos. 54-5698 and 52-29199 disclose systems in which an audio signal generator is provided for each of a plurality of sensors in fire alarm equipment. In either of the above systems, a tone converter such as a loudspeaker is provided for each sensor so that the sensor generates an alarm sound upon operation. Therefore, an "ON" sensor can be easily discriminated from "OFF" sensors.

However, according to the above conventional systems, if the system is installed in a building such as a hotel having a large number of private rooms, only a person in a room where a sensor is operated, and maintenance personnel in a control room where a receiver is installed, will be informed of an alarm state. Therefore, escape of others may be delayed upon occurrence of a fire or the like.

In some systems, special lines extend from the receiver to, e.g., alarm bells provided in common places such as hallways so that the alarm bells generate alarm sounds in synchronism with the activated sensor. However, since sound insulation of buildings has recently been improved, people inside the rooms often do not notice the alarm sounds. On the other hand, if the alarm sound is increased louder than necessary, people may be confused and cause a panic when a false alarm is generated.

SUMMARY OF THE INVENTION

It is, therefore, an object of the present invention to provide an alarm apparatus which can perform selective control of the audio alarm signals.

It is another object of the present invention to provide an inexpensive alarm apparatus in which no alarm control line need be provided.

The above objects are achieved in accordance with the principles of the present invention in an alarm system having a plurality of sensors connected in parallel with each other between sensor lines extending from a receiver and audio devices connected between the sensor lines in correspondence with at least one of the sensors. The receiver includes means for changing a voltage supply condition of the sensor lines, and a control circuit is provided to each of the audio devices so as to selectively control the audio devices when the voltage supply condition is changed, so that an audio device corresponding to an activated sensor, or all of the audio devices, can be arbitrarily controlled to generate tones.

As described above, according to the present invention, an abnormal state is checked in, e.g., a maintenance room, and then audio devices are selectively controlled to generate tones. Therefore, a countermeasure corresponding to the abnormal state can be smoothly taken.

DESCRIPTION OF THE PREFERRED EMBODIMENTS

Figure 1:
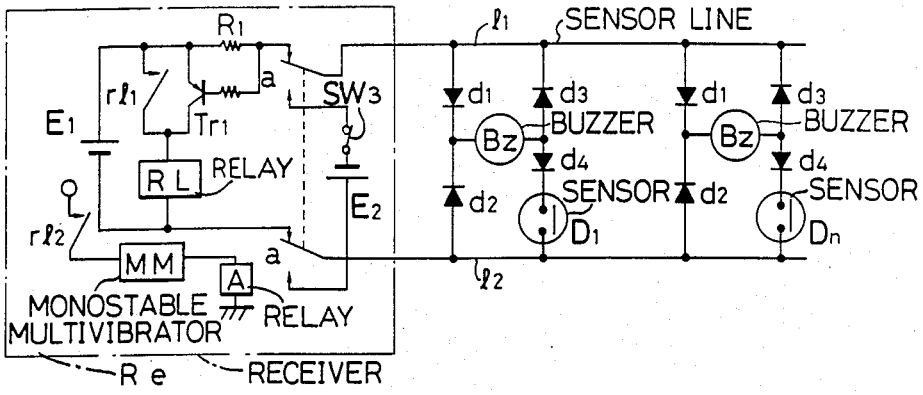
FIG. 1 is a circuit diagram of an alarm apparatus according to an embodiment of the present invention.

FIG. 1 shows a first embodiment of the present invention. In FIG. 1, sensor lines l1 and l2 extend from a first power source E1 of a receiver Re through a resistor R1 and switches a. A plurality of sensors (D1 to Dn), i.e., a plurality of diode bridges, are provided between the lines l1 and l2. Each diode bridge consists of diodes d1 to d4 for controlling an audio device, such as a buzzer Bz, and a sensor D.

The resistor R1 is connected between the emitter and the base of a transistor Tr1, and the collector of the transistor Tr1 is connected to the power source E1 through a relay RL.

A second power source E2 having polarities opposite to those of the first power source E1 is connected to normally open contacts of the switches a. The switches a are contacts of a relay A operated by the output of monostable multivibrator MM driven by a normally open contact rl2 of the relay RL.

Figure 2:
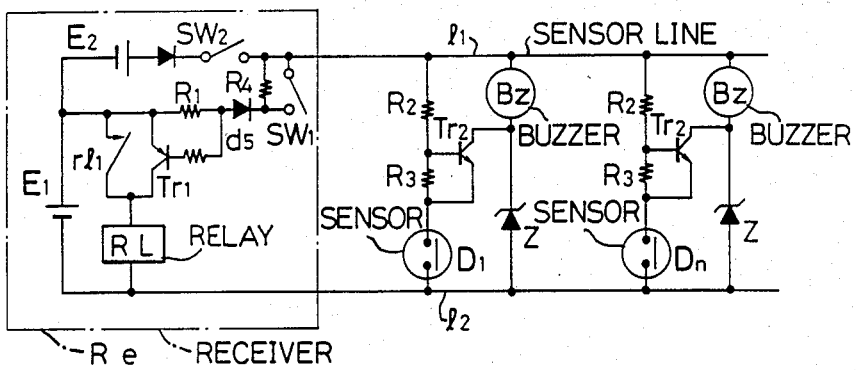
FIG. 2 is a circuit diagram of an alarm apparatus according to another embodiment of the present invention.

In the above arrangement, if, for example, the sensor D1 operates, a closed circuit is formed through the power source E1, the resistor R1, the line l1, the diode d1, the buzzer Bz, the diode d4, the sensor D1, and the line l2, thereby operating the buzzer Bz to generate an audio signal. At the same time, the transistor Tr1 is turned on to operate the relay RL and is maintained conducting by the contact rl1, and the second contact rl2 is turned on to drive the monostable multivibrator MM. In this case, the monostable multivibrator MM is set to generate an output following a delay of from several seconds to several minutes after it is turned on. Thereafter, the relay A is operated. Upon operation of the switches a of the relay A, the sensor lines l1 and l2 are connected to the second power source E2 and therefore have opposite polarities. As a result, a power source voltage is applied to all the buzzers Bz through the diodes d2, the buzzers Bz, and the diodes d3 so that the buzzers Bz all generate audio signals at the same time. The power sources E1 and E2 thus in combination form a voltage supply having two mutually exclusive states, in this embodiment those states being oppositely polarized. In the embodiment of FIG. 2, the states have different voltage magnitudes.

The receiver Re may have an alarm display (not shown). Therefore, after any of the sensors operates, the authenticity of an alarm can be checked before the monostable multivibrator MM generates its output. If the alarm is a false one, the apparatus can be recovered before the buzzers simultaneously generate the audio signals. This is schematically indicated by a manually operated, normally closed switch SW3 in series with E2, however, any suitably connected manually operated switch will suffice. In addition, if an emergency occurs, the switches a may be manually driven to operate the buzzers to generate the signals.

FIG. 2 shows another embodiment. In FIG. 2, a series circuit consisting of a diode d5 for preventing a reverse current and a resistor R4 is connected in parallel across a normally open switch SW1, which is connected between a resistor R1 and the line l1 of FIG. 1. A second power source E2 is connected in series with a first power source E1 and is connected to the line l1 through a normally open switch SW2. Each buzzer Bz is connected in series with a Zener diode Z and is connected between the lines (1 and (2. An emitter-to-collector path of a transistor Tr2, which is forward-biased and turned on upon operation of a corresponding one of sensors D1 to Dn, is connected to a series node between the buzzer Bz and the Zener diode Z.

In the above arrangement, resistors R1, R2, R3 and R4 are set such that only the transistor Tr1 is initially turned on if, e.g., the sensor D1 operates. When the transistor Tr1 is turned on, a relay RL is operated and self-held by a self-holding contact rl1, thereby driving an alarm display (not shown). In order to check the above operation by a receiver Re and then to operate a buzzer Bz corresponding to the ON sensor, the resistances of the resistors R1 to R4 are set such that th switch SW1 is turned on to short-circuit the resistor R4 and hence the transistor Tr2 is turned on to operate the corresponding buzzer Bz.

In order to operate all the buzzers Bz between the lines l1 and l2, the switch SW2 is closed. When the switch SW2 is closed, a sum voltage of voltages of the two power sources E1 and E2 is supplied between the lines l1 and l2. In this case, if a voltage V of the Zener diode Z series-connected to the buzzer Bz is set such that $E1<V<E1+E2$, all the buzzers Bz generate an audio signal. Although the switches SW1 and SW2 are arbitrarily and selectively operated, they can be sequence-controlled in synchronism with each other.

Note that in the above embodiments, the buzzer Bz is provided to each of all the sensors D1 to Dn. However, the buzzers Bz may be provided to only selected sensors D, and resistors serving as a pseudo load may be connected to the other sensors.

As has been described above, according to the alarm apparatus of the present invention, without providing an additional alarm control line, buzzers provided in correspondence to sensors can be selectively controlled such that only a buzzer corresponding to an ON sensor generates an audio signal or all the buzzers generate audio signals at the same time. Therefore, escape is not delayed even in a building with high sound insulation, and system-wide false alarms are avoided.

Although modifications and changes may be suggested by those skilled in the art it is the intention of the inventors to embody within the patent warranted hereon all changes and modifications as reasonably and properly come within the scope of their contribution to the art.

We claim as our invention:

1. An alarm apparatus comprising:

a receiver having a pair of sensor lines proceeding therefrom;

a plurality of sensor means for sensing abnormal conditions connected in parallel across said sensor lines;

a plurality of audio signal generators connected in parallel across said sensor lines, at least one of said audio signal generators being associated with one of said sensor means;

a voltage supply means in said receiver connected across said sensor lines for supplying power to said sensor means and to said audio signal generator, said voltage supply means having two mutually exclusive states;

means in said receiver for changing the state of said voltage supply means after sensing of an abnormal condition by one of said sensor means; and control means connected between each audio signal generator and said sensor lines for energizing said at least one audio signal generator with said voltage supply means in one of said states upon sensing of an abnormal condition by one of said sensor means, and for subsequently energizing at least one further audio signal generator with said voltage supply means in the other of said states upon the change os state of said voltage supply means.

2. An alarm apparatus as claimed in claim 1, wherein each sensor means in said plurality of sensor means is associated with one audio signal generator in said plurality of audio signal generators.

3. An alarm apparatus as claimed in claim 1, further comprising:

means for manually overriding said control means to prevent said control means from energizing said at least one further audio signal generator.

4. An alarm apparatus comprising:

a receiver having a pair of sensor lines proceeding therefrom;

a plurality of sensor means for sensing abnormal conditions connected in parallel across said sensor lines;

a plurality of audio signal generators connected in parallel across said sensor lines, at least one of said audio signal generators being associated with one of said sensor means;

a first voltage supply in said receiver having a polarity;

a second voltage supply in said receiver having a polarity opposite to the polarity of said first voltage supply;

relay means in said receiver switchable responsive to the sensing of an abnormal condition by one of said sensor means for connecting said first voltage supply to said at least one audio signal generator;

timer means for generating a signal following a selected delay after switching of said relay means;

means responsive to said signal from said timer means for connecting at least one further audio signal generator to said second voltage supply after said selected delay; and a plurality of bridge means connected in parallel across said sensor lines, for preventing energization of said audio signal generators by said first supply voltage, except said at least one audio signal generator, and for permitting energization of all audio signal generators by said second voltage supply.

5. An alarm system as claimed in claim 4, wherein each bridge means comprises:

first and second diodes having a polarity corresponding to the polarity of said first voltage supply connected in series with an audio signal generator and a sensor means across said sensor lines, and third and fourth diodes having a polarity corresponding to the polarity of said second voltage supply connected in series with said one audio signal generator across said sensor lines.

6. An alarm apparatus as claimed in claim 4, wherein said means responsive to said signal from said timer means is a relay.

7. An alarm apparatus as claimed in claim 4, further comprising means for manually overriding said means responsive to said signal from said timer means for preventing connection of said second voltage supply to said at least one further audio signal generator.

8. An alarm apparatus comprising:

a receiver having a pair of sensor lines proceeding therefrom;

a plurality of sensor means for sensing abnormal conditions connected in parallel across said sensor lines;

a plurality of audio signal generators connected in parallel across said sensor lines, at least one audio signal generator being associated with one of said sensor means;

first and second voltage supplies in said receiver; means for connecting one of said voltage supplies across said sensor lines upon the sensing of an abnormal condition by one of said sensor means;

means for connecting both said first and second voltage supplies in series across said sensor lines after a selected delay following said sensing of an abnormal condition; and means connected to each of said audio signal generators across said sensor lines to prevent said audio signal generators, except said one audio signal generator, from being energized by said first voltage supply and for permitting all of said audio signal generators to be energized by both said first and second voltage supplies.

9. An alarm apparatus as claimed in claim 8, wherein said means connected to each of said audio signal generators is a Zener diode connected in series therewith across said sensor lines, said Zener diode having an operating voltage higher than the voltage of said first voltage supply and lower than the voltage of said first and second voltage supplies in series.

* * * * *